United States Patent [19]

Milligan

[11] Patent Number: 4,465,985

[45] Date of Patent: Aug. 14, 1984

[54] HARDWIRE MISSILE RECEIVER COUPLER

[75] Inventor: Thomas A. Milligan, Littleton, Colo.

[73] Assignee: The United States of America as represented by the Secretary of the Air Force, Washington, D.C.

[21] Appl. No.: 353,983

[22] Filed: Mar. 2, 1982

[51] Int. Cl.[3] ..... H01P 5/18

[52] U.S. Cl. ..... 333/116; 343/708

[58] Field of Search ..... 333/115, 116, 24 R, 333/127, 128, 26; 343/708

[56] References Cited

U.S. PATENT DOCUMENTS 3,237,130 2/1966 Cohn ..... 333/115

*Primary Examiner*—Paul L. Gensler
*Assistant Examiner*—Benny Lee
*Attorney, Agent, or Firm*—Donald J. Singer; William Stepanishen

[57] ABSTRACT

A hardwire missile receiver coupled line apparatus is inserted between the antenna output port and the receiver input in a missile communication link to allow signals to be coupled directly into the missile receiver before the missile launch. At launch, the cable to the side of the missile is pulled from the side of the missile. After the cable is pulled, the open circuited cable between the side of the missile and the coupling network does not degrade the signal transmission from the antenna to the receiver.

5 Claims, 5 Drawing Figures

FIG. 1
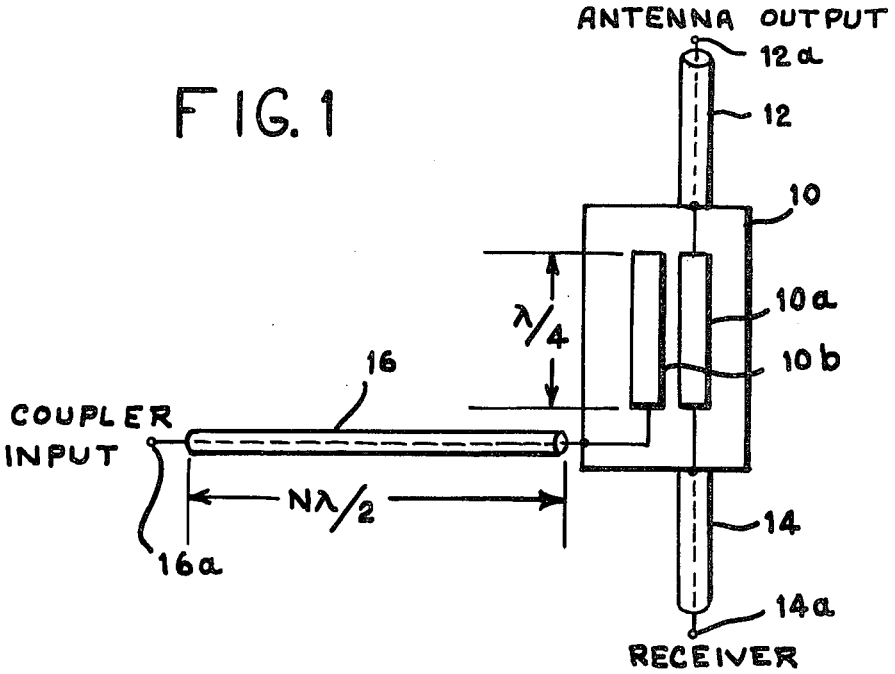
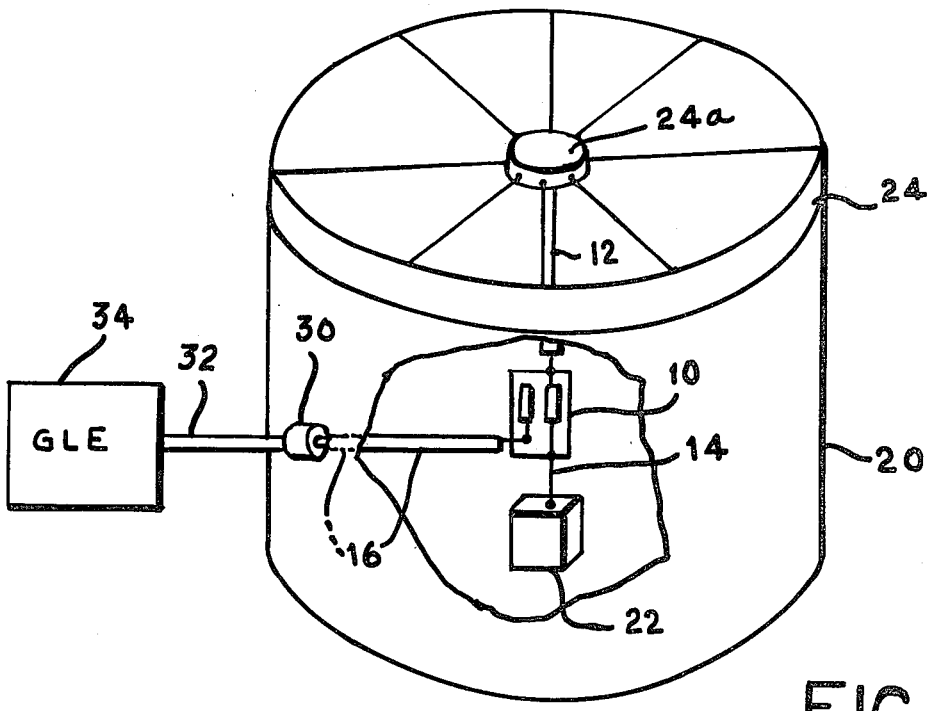
FIG 2

HARDWIRE MISSILE RECEIVER COUPLER

STATEMENT OF GOVERNMENT INTEREST

The invention described herein may be manufactured and used by or for the Government for governmental purposes without the payment of any royalty thereon.

BACKGROUND OF THE INVENTION

The present invention relates broadly to a missile receiver system, and in particular to a hardwire missile receiver coupler apparatus.

In the area of missile communication systems for missiles that are still on the ground the most common practice was to transmit command and control signals to the missile via the missile's space antenna. In order to communicate with the missile by these means, it was necessary in the prior practice is to use either an R.F. switch in place of the coupled line network or to couple into the missile antenna with a coupler antenna. However, if the R.F. switch fails to operate properly by failing to switch from either the ground mode to the airborne mode or visa versa, the receiver may never receive any data that is transmitted by ground crews in either the ground or airborne mode. It may also be noted that with very large distributed antennas, the external coupler itself must be very large in order to provide sufficient coupling to the receiver. Thus, it may be seen that the need exists for an effective missile communication system that permits communication with the missile while it is still in its on-ground cannister as well as to provide an efficient communication link with the airborne missile.

SUMMARY OF THE INVENTION

The present invention utilizes a coupled line network which is coupled between the antenna output port and the receiver input, to allow command and other signals to be inserted directly into the missile receiver before the missile is launched. The coupled line network is connected to the ground command system through a cable which is attached to the coupling network through the side of the missile. At launch, the cable to the external side of the missile is pulled free from the side of the missile. After the cable is disconnected from the coupled line network, the open circuited cable on the internal side of the missile, does not effect and thereby does not degrade the transmission between the antenna and receiver.

It is one object of the present invention, therefore, to provide an improved hardwire missile receiver coupler apparatus.

It is another object of the invention to provide an improved hardwire missile receiver coupler apparatus utilizing a quarter-wave coupled pair transmission line.

It is yet another object of the invention to provide an improved hardwire missile receiver coupler apparatus wherein the coupler connector cable is an integer number of half wavelengths long.

It is still another object of the invention to provide an improved hardwire missile receiver coupler apparatus wherein the input port to the coupled pair transmission line is an open circuit after missile launch.

It is an even further object of the invention to provide an improved hardwire missile receiver coupler apparatus wherein the inserted coupler network appears as a matched section of transmission line at the center frequency.

These and other advantages, objects and features of the invention will become more apparent after considering the following description taken in conjunction with the illustrative embodiment in the accompanying drawings.

BRIEF DESCRIPTION OF THE DRAWINGS

FIG. 1 is a schematic diagram of the hardwire missile receiver coupler apparatus according to the present invention;

FIG. 2 is a pictorial view of the hardwire missile receiver coupler apparatus with respect to the missile antenna, receiver, and missile housing.

DESCRIPTION OF THE PREFERRED EMBODIMENT

Figure 3:
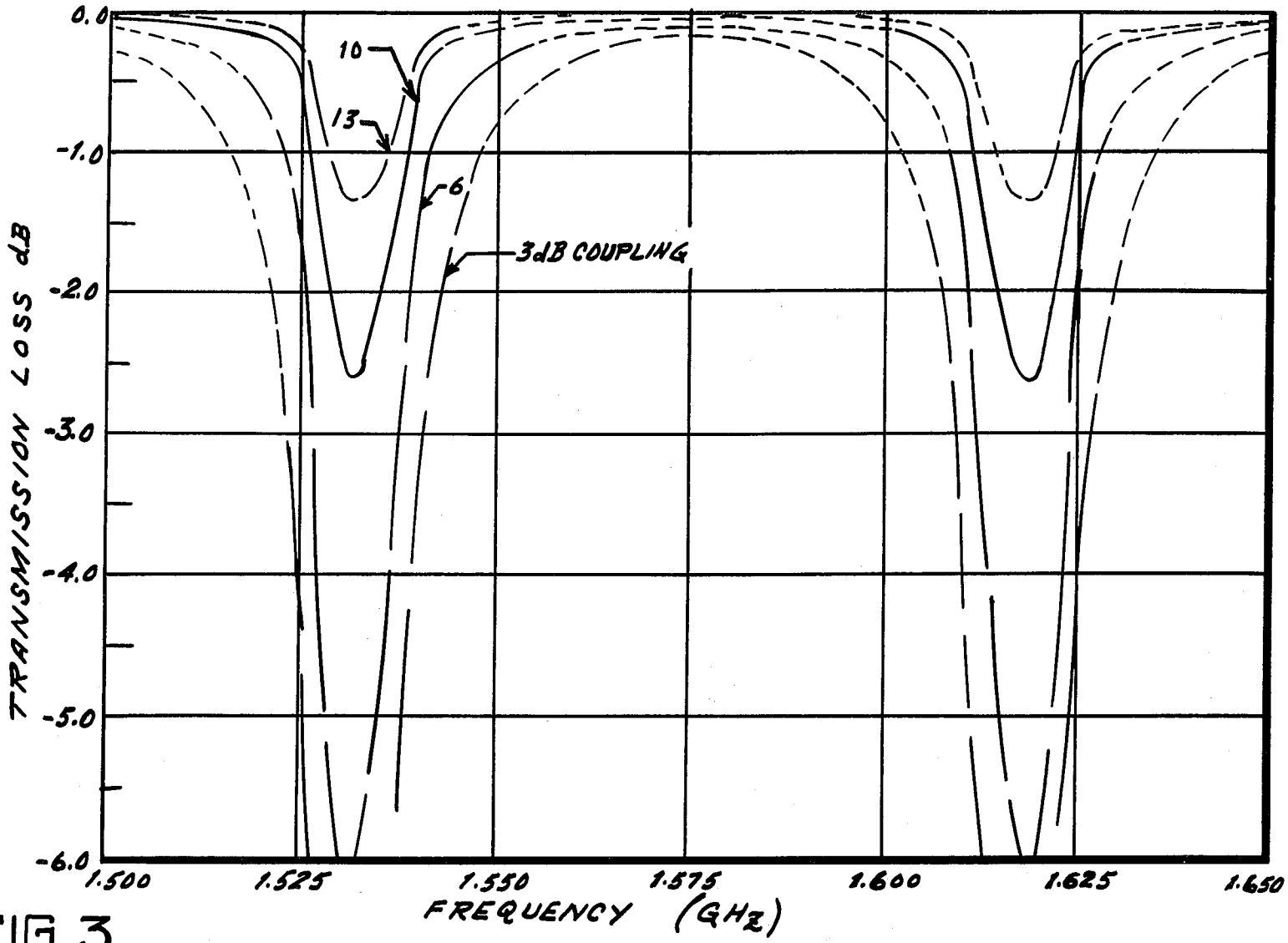
FIGS. 3, 4 and 5 are graphical representations respectively of the hardwire missile receiver coupler apparatus transmission loss, voltage standing wave ratio versus frequency, and coupling versus angle.

Referring now to FIG. 1, there is shown a hardwire missile receiver coupler apparatus which permits the coupling of communication signals with an on-ground missile. The hardwire missile receiver coupler apparatus comprises a quarter-wavelength coupled pair transmission line 10, an antenna coax cable 12, a receiver coax cable 14, and an input coupler coax cable 16. The quarter-wavelength coupled pair transmission line 10 may be implemented by a stripline, a microstrip, coupled rods or any other suitable connection means. The required even and odd mode impedances for the coupled pair transmission line 10 are given and defined by the following equations. For a coupled pair of transmission lines, the coupling coefficient CD in dB is defined as: $CE=10^{(-CD/20)}$ and $AK=(1+CE)/(1-CE)$ where CE is the voltage coupling coefficient between coupled lines, and the constant, AK, is the square of the normalized even mode impedance required to obtain a given coupling in a four port coupler. Therefore, the even mode impedance is $ZE=Z\cdot AK/(AK+1)$, and the odd mode impedance $ZO=ZE/AK$, where Z is system impedance.

One line **10*a* of the coupled line transmission line 10 is connected to the antenna output port 12*a* by means of antenna coax cable 12 and is connected to the receiver input port 14*a* by means of receiver coax cable 14. The other line 10*b* of the coupled line transmission line pair 10 is open circuited on the side toward the antenna output while the other end of line 10*b* is connected by coax cable 16 to the coupler input 16*a*. The coax cable length of coax cables 12, 14 are dimensioned to give a reflection coefficient angle=180° at frequency $F_o$. The coax cable length of coax cable 16 is given by the equation: $N\lambda/2$ where N is a positive integer. When the coupler input 16*a*** is an open circuit, there is no transmission loss between the antenna and the receiver due to the insertion of the coupler unit therebetween.

Turning now to FIG. 2, there is shown a missile housing 20 which contains a receiver unit 22, a coupler unit 10 and an antenna unit 24. The antenna unit 24 include a power divider unit **24*a* which is connected by means of coax cable 12 to the coupler unit 10. The receiver unit 22 is connected by means of coax cable 14 to the coupler unit 10. The coupler unit 10 is connected by the input coupler coax cable 16 to and through the side of the missile housing 20. The cable 16 which is attached to the side of the missile vehicle 20, is the input port to the coupler unit 10. The coax cable 16 is externally terminated with a push-on connector 30 that must be an integer number of half wavelengths long including the connectors. Before the missile is launched, this coax cable 16 is connected by means of an umbilical cable 32 to the external ground launch equipment (GLE) 34. At launch, the external umbilical cable is pulled free of the missile housing 20, thereby open circuiting coax cable 16. The open circuited cable 16 reflects an open circuit to the coupled pair of transmission lines coupled port. This has the effect of changing the effective impedance of the transmission line 10***a* through the coupled pair. The even and odd mode impedances have been adjusted to provide the system impedance when the external cable is removed from the input coupler coax cable 16. The inserted coupler network 10 looks like a matched section of transmission line at the center frequency to the receiver unit 22.

Figure 4:
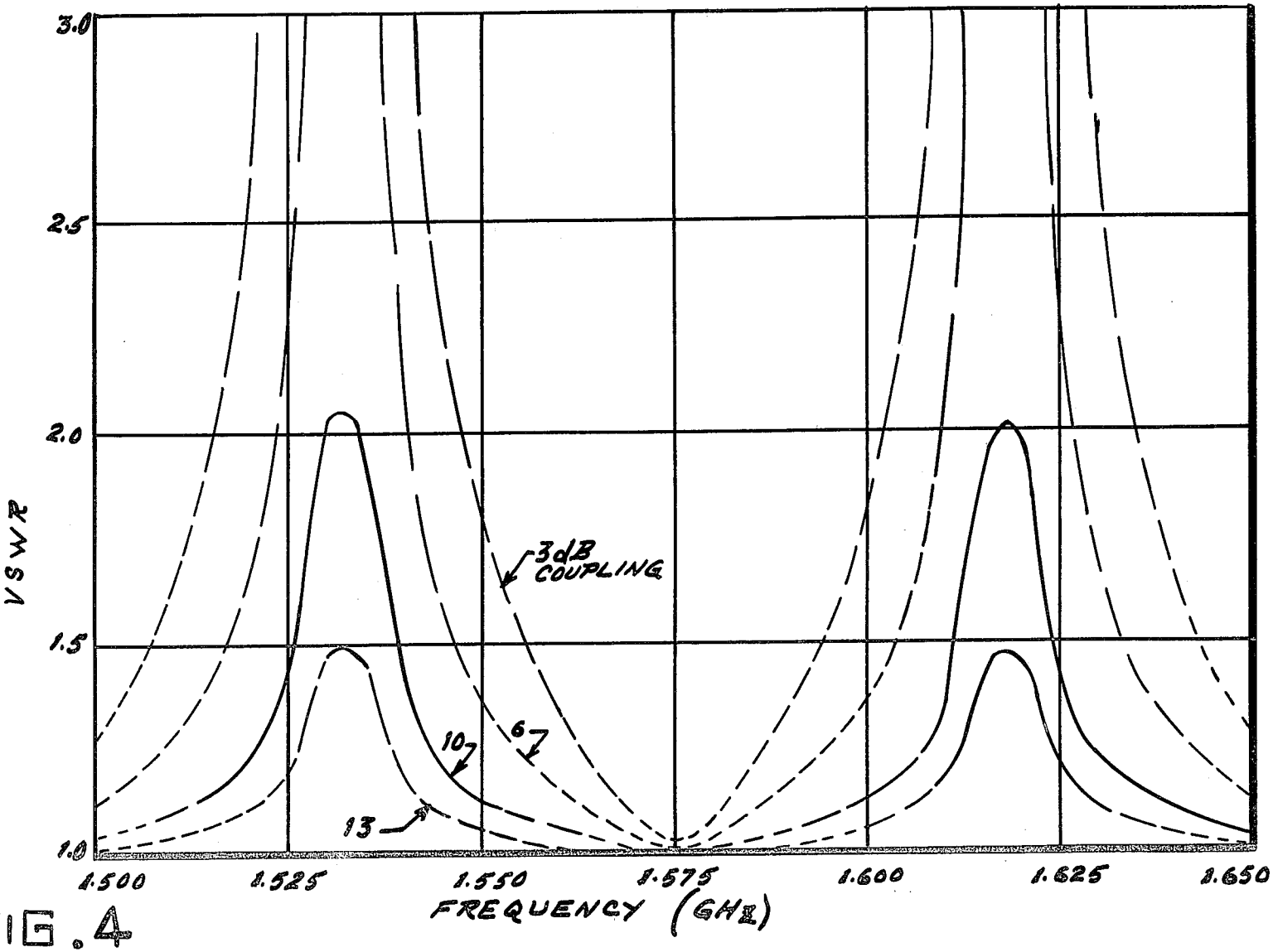
Figure 5:
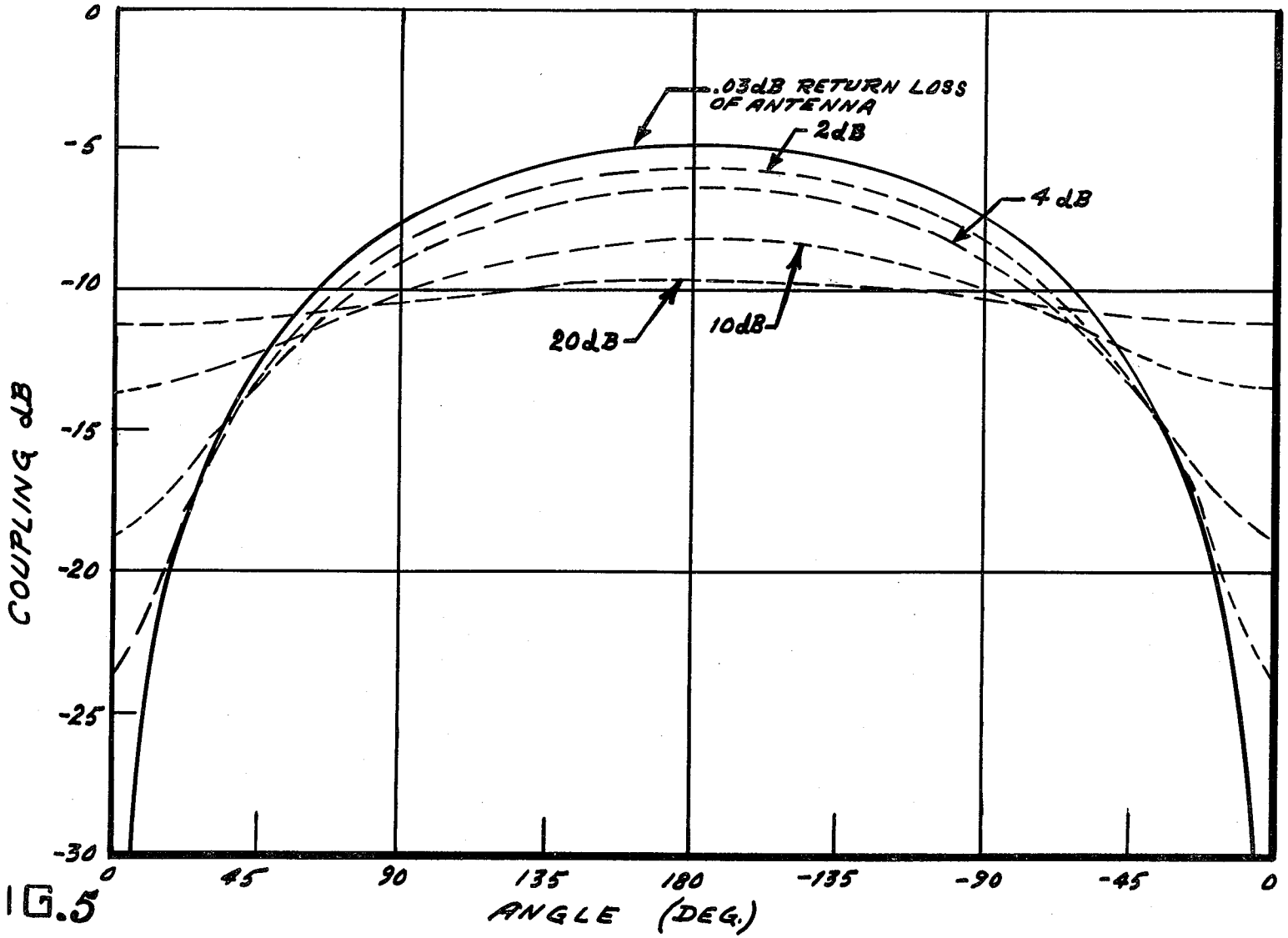

There is shown in FIGS. 3, 4 and 5 the graphical representations of the transmission and coupling characteristics for a typical hardwire missile receiver coupler apparatus. The critical features for the coupled line coupler apparatus which are illustrated in FIGS. 3, 4 and 5 are as follows: the quarter-wavelength coupled pair transmission has a Q equal to 300 and the input coupler coax cable has a length of 46.765 inches with a Q equal to 400. In FIG. 3, there is shown the transmission loss in dB versus frequency for the above coupled line hardwire receiver coupler apparatus when inserted between the antenna and the receiver. In FIG. 4, there is shown the input VSWR characteristics at the antenna terminals versus frequency for the receiver coupled line apparatus. Finally, in FIG. 5, there is shown the receiver coupled line apparatus coupling variation with varying angle of reflection from the antenna, in a plot of coupling in dB versus angle in degreee.

Although the invention has been described with reference to a particular embodiment, it will be understood to those skilled in the art that the invention is capable of a variety of alternative embodiments within the spirit and scope of the appended claims.

What is claimed is:

1. A hardwire missile receiver coupler apparatus comprising in combination:

a quarter-wavelength coupled pair of transmission lines which comprise a first and second transmission line means, said first transmission line means having a first and second port, said first port to receive the output from an antenna, said second port to provide an input to the receiver terminal, said second transmission line means having a first and second port, said first port being open-circuited toward said antenna side of said transmission line, and, an input coupler cable having one end connected to said second port of said second transmission line means, said input coupler cable having a predetermined length, said input coupler cable being terminated at its other end in a push-on connector, said push-on connector providing external communication access to said first transmission line means by means of an umbilical cable to the external ground equipment, at launch, the external umbilical cable is pulled free from said input coupler cable to provide an open circuit thereto, said open circuited input coupler cable reflects an open circuit to said coupled pair of transmission lines which changes the effective impedance of said first transmission line means.

2. A hardwire missile receiver coupler apparatus as defined in claim 1 wherein said first and second transmission line means each respectively comprising a microstrip.

3. A hardwire missile receiver coupler apparatus as described in claim 1 wherein said first and second transmission line means each respectively comprise a stripline.

4. A hardwire missile receiver coupler apparatus as described in claim 1 wherein said predetermined length of said input coupler cable equals $N\lambda/2$ where N is a positive integer.

5. A hardwire missile receiver coupler apparatus as described in claim 1 wherein said coupler pair of transmission lines have even and odd mode impedances wherein said even mode impedance is defined by $ZE=Z\cdot AK/(AK+1)$ and said odd mode impedance is defined by $ZO=ZE/AK$, where Z is system impedance and $AK=(1+CE)/(1-CE)$, where CE is the voltage coupling coefficient between coupled lines, and the constant, AK, is the square of the normalized even mode impedance.

* * * * *